US005456294A

United States Patent [19]

Tsao et al.

[11] Patent Number: 5,456,294

[45] Date of Patent: Oct. 10, 1995

[54] NONSPILL BOTTLED WATER REPLACEMENT SYSTEM WITH A SHIELDED DISPOSABLE CAP

[75] Inventors: Chein-Hwa Tsao, Saratoga; Robert N. Lee, Palo Alto; Boris Shteynberg, San Francisco; Cecil Davis, Saratoga, all of Calif.

[73] Assignee: Innostar, Inc., San Jose, Calif.

[21] Appl. No.: 218,053

[22] Filed: Mar. 25, 1994

Related U.S. Application Data

[63] Continuation-in-part of Ser. No. 13,778, Feb. 5, 1993, Pat. No. 5,363,890.

[51] Int. Cl.[6] ..... B65D 47/00

[52] U.S. Cl. ..... 141/1; 141/2; 141/21; 141/351; 141/364; 222/213; 222/491; 222/494; 222/545; 215/237

[58] Field of Search ..... 141/1, 2, 18, 21, 141/319–322, 351–354, 359, 363–366; 222/1, 212, 213, 491–494, 545, 556, 562; 215/237

[56] References Cited

U.S. PATENT DOCUMENTS

| | | | |
|---|---|---|---|
| 2,084,529 | 6/1937 | Landau | 222/492 |
| 2,605,939 | 8/1952 | Fuchslocher | 222/491 |
| 3,456,650 | 7/1969 | Schwartzman | 222/212 X |
| 3,622,041 | 11/1971 | Borsum | 141/321 X |
| 3,754,690 | 8/1973 | Marchant | 222/494 |
| 4,747,522 | 5/1988 | McIntyre | 222/213 |
| 4,754,898 | 7/1988 | Britt et al. | 222/545 X |
| 5,228,603 | 7/1993 | Pham et al. | 222/562 |
| 5,297,703 | 3/1994 | Tsao et al. | 141/364 X |

*Primary Examiner*—J. Casimer Jacyna

*Attorney, Agent, or Firm*—James J. Leary; Carol A. Duffield

[57] ABSTRACT

A bottle cap having a valve which provides a water tight seal to prevent spillage when a water bottle is inverted for installation onto a water dispenser, but which can be opened after the water bottle is installed by generating a hydraulic shock wave within the bottle to open the valve. A first embodiment has a triple valve seal with mechanical interference between the valve pieces to create an initially water tight seal. A second embodiment employs a dual valve structure. A third embodiment employs a single valve structure. In the first three embodiments, the valves are pivotally attached to the valve body by flexible living hinges. A fourth embodiment has a single linearly sliding valve. Three methods are presented for generating the hydraulic shock wave to open the valve. In the first method, the water bottle is positioned just above the water dispenser and lowered rapidly. In the second method, the bottle is placed on the dispenser and tipped so that one shoulder of the bottle is just above the top opening of the dispenser, then the bottle is allowed to settle back into place. These two methods create an inertial shock wave when the bottle comes to rest. In the third method, the bottle is placed on the dispenser with the seal intact, and the user strikes the top or the sides of the water bottle to create the hydraulic shock wave.

12 Claims, 10 Drawing Sheets

NONSPILL BOTTLED WATER REPLACEMENT SYSTEM WITH A SHIELDED DISPOSABLE CAP

RELATIONSHIP TO OTHER APPLICATIONS

This patent application is a continuation-in-part of patent application Ser. No. 08/013,778, filed Feb. 5, 1993, now U.S. Pat. No. 5,363,890, the specification of which is hereby incorporated by reference in its entirety.

FIELD OF THE INVENTION

The present invention relates in general to water dispensers of the type which have a water bottle that is inverted and loaded onto a water dispenser. More specifically, it relates to a device for preventing spillage when the water bottle is inverted during installation and a method for its use.

BACKGROUND OF THE INVENTION

Many offices, stores, factories and homes are equipped with drinking water dispensers for their members. While some dispensers are plumbed permanently to a tap water supply, others employ a user replaceable supply, such as an inverted water bottle removably mounted on top of the dispenser. Examples of the design of such dispensers are U.S. Pat. No. 3,698,603 issued October 1972 to Radcliffe and U.S. Pat. No. 4,664,349 issued May 1987 to Johansen.

One of the primary difficulties with such prior art dispenser systems employing an inverted bottle lies in the procedure of user replacement of a used bottle. At this time, a nearby full bottle has to be substituted in its place. Typically the bottles are of 5 gallon capacity and therefore very heavy. This means that, after the user removes the used bottle and opens the cap of the full bottle, the user would have to lift the full bottle and, in one very quick movement, invert it and insert its neck accurately into the intake opening on top of the dispenser and maneuver the body of the bottle into vertical position for normal operation. Any less than good execution of this exceptionally demanding procedure will result in excessive water spillage plus possible personal injury. In any case, the current procedure always wastes some water through unavoidable spillage, in addition to being dangerous to the user.

Two prior patents taught the idea of, upon loading of the full container, piercing an otherwise sealing member of the container thus establishing either the flow of one single fluid or the simultaneous flow of two different fluids from the supply bottle. The piercing element being a permanent part of the dispenser. These are U.S. Pat. No. 1,248,704 issued October 1916 to Pogue and U.S. Pat. No. 4,676,775 issued June 1987 to Zolnierczyk, et al. But the implementation of these methods would require the modification of the existing dispensers and bottles which is undesirable.

Other prior art patents have taught the use of a frangible, burstable or releasable membrane seal attached to a squeezable plastic bottle, such as a container for motor oil. The membrane prevents spillage of the contents as the bottle is inverted. Once the bottle is in place, the bottle is squeezed to create an internal pressure which opens the seal, allowing the contents to pour out. Examples of these can be found in U.S. Pat. Nos. 5,105,986 to Pham et al. for Non-Spill Inverter Devices, Containers, and Methods, 4,938,390 to Markva for a Liquid Storage Container with Dispensing Closure, 4,789,082 to Sampson for Container Discharge Control, and 4,696,328 to Rhodes, Jr. for Spillage Prevention. These devices and methods are unsuitable for water bottles which are made of rigid materials such as glass, polycarbonate or other rigid plastics. These rigid containers resist being squeezed which prevents the user from generating enough internal pressure to burst the seal.

OBJECTIVES AND SUMMARY OF THE INVENTION

A principal objective of the present invention is to provide a device which prevents spillage when a water bottle is inverted for installation onto a water dispenser. It is also an objective to provide a method for establishing the flow of water from the water bottle into the water cooler after the bottle has been inverted and installed onto the water dispenser. It is preferable that the device be buildable from low cost materials so that it does not add significantly to the cost of the water bottle and so that it can be made disposable if desired. The device should also be buildable from recyclable materials. Another objective of the invention is to provide the device in embodiments which are suitable for automated installation by the water bottling company and for hand application by the end user.

Accordingly, the present invention takes the form of a cap with integrated valve closure which initially provides a water tight seal on the mouth of the water bottle, but which can be opened after the water bottle is installed by generating a hydraulic shock wave within the bottle to open the valve and allow water to flow from the bottle. The first embodiment has a triple valve seal with mechanical interference between the valve pieces to create an initially water tight seal. Living hinges are used as the articulating mechanism for the valves. The cap is further enclosed in a user tear-off shrink film for mechanical protection and total sanitation during storage, transportation and handling of the bottle. After the user tears off the shrink film, the three valves would all pop open when they are subjected to a hydraulic shock wave, thereby opening the seal and allowing the water to flow out. The second embodiment is the same as the first except for the employment of a dual valve structure facilitating the closure of the valves fight after the cap gets molded during the manufacturing process. The third embodiment is also the same as the first except for the employment of a single valve structure. The fourth embodiment is also a single valve design except the valve is of a linearly sliding type with appropriate guide and hook structures for direction and position control. Any of the embodiments of the invention may be used in lieu of the tear-away plastic caps currently used for water bottles.

The water bottle is made of a rigid material, which prevents the user from squeezing the bottle to release the seal, as in the prior art methods. In order to release the seal, the user generates a hydraulic shock wave in the water inside the bottle. The shock wave opens the seal and allows the water to flow from the bottle. Three methods are presented for generating the necessary hydraulic shock wave. In the first method, the water bottle is positioned a few inches above the top opening of the water dispenser. The bottle is lowered rapidly onto the dispenser opening, which creates an inertial shock wave when the bottle comes to rest. In the second method, the water bottle is placed on the top opening of the water dispenser with the seal intact. The bottle is then tipped so that one shoulder of the bottle is a few inches above the top opening of the water dispenser, then the bottle is allowed to settle back into place, which creates an inertial shock wave when the bottle comes to rest. In the third method, the water bottle is placed on the top opening of the water dispenser with the seal intact, and the user strikes the bottom or the sides of the water bottle to create the hydraulic shock wave. With any one of the disclosed methods, the user can carefully place the water bottle on or over the water dispenser without danger of spillage. Then, once the bottle is safely in place, the user can initiate a hydraulic shock wave which opens the seal and allows the water to flow out.

The invention allows the user to install a full water bottle onto a water dispenser without any danger of spilling. Thus, the user can slowly and carefully invert the water bottle and place it in the correct position. This is much easier and safer than the current practice, which requires speed, strength and coordination to quickly invert the unsealed bottle and place it on the water dispenser before the water gushes out. Other objects and advantages of the invention will become apparent from reading and understanding the following detailed description along with the accompanying drawings.

DETAILED DESCRIPTION OF THE PREFERRED EMBODIMENTS

As mentioned previously, the present invention is designed for use with a water bottle which is made of a rigid material. Water bottles for household and office water dispensers are commonly made in 3 gallon and 5 gallon sizes. The geometry of current water bottles varies from cylindrical to cubic. The preferred material for such water bottles is a rigid polymer, most commonly polycarbonate, but other rigid materials such as glass, polyethylene terephthalate or rigid PVC can also be used. The rigidity of the bottle material strongly resists squeezing of the bottle, which makes prior art methods that rely on squeezing a bottle to open a releasable seal ineffective. Because of the universal acceptance of rigid water bottles for water dispensers, it is important to devise a method of avoiding water spillage which is compatible with these rigid containers.

Figure 1A:
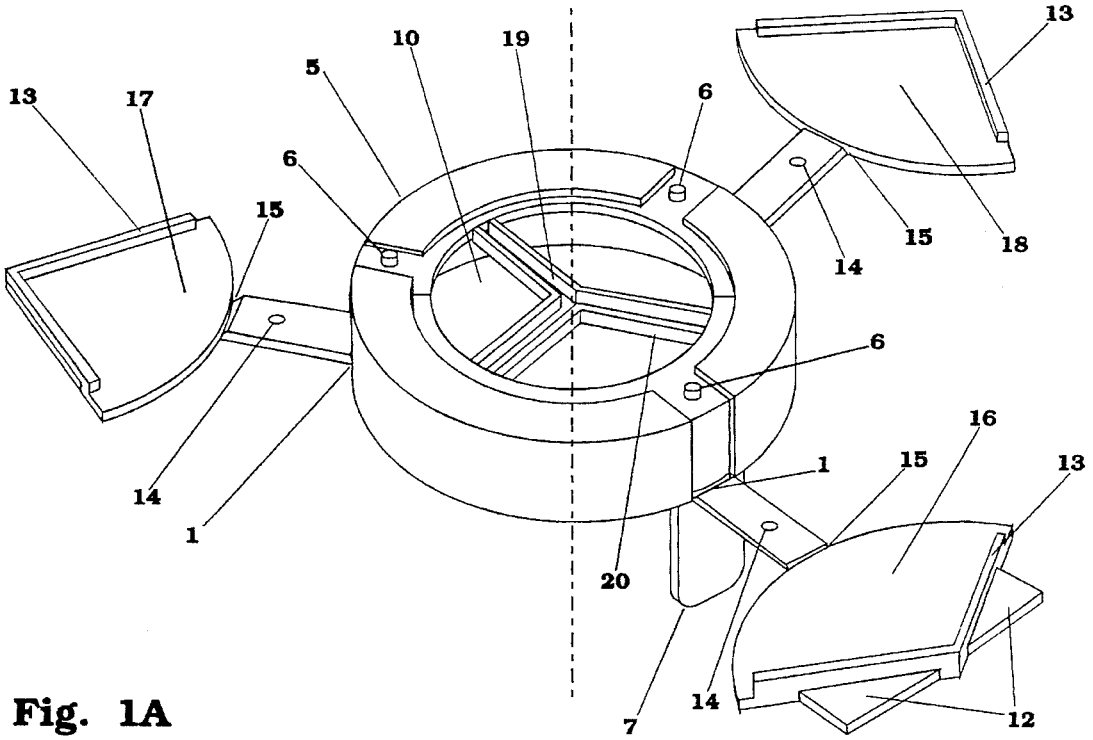
FIGS. 1A and 1B show a cap closure with triple valves as it is manufactured and as the three valves just touch each other when they are folded onto the cap body via the living hinges.

FIG. 1A shows a cap body 5 with three sector shaped valves 16, 17 and 18. The device is of one piece construction made of a somewhat compliant material such as the plastic low density polyethylene. The valves are connected to the cap body 5 through valve beams 33, 34 and 35 with valve living hinges 15 on the valve side and body living hinges 1 on the body side. The cap body 5 has three cap body locking posts 6 which interlock with three valve beam locking holes 14 to permanently capture the corresponding valve beams 33, 34 and 35 when they are later folded back onto the cap body 5 via body living hinges 1. The cap body locking posts 6 should have a tight interference fit with the valve beam locking holes 14 to assure a firm attachment. All valves have sealing ribs 13 designed to press against one another to form a spill free seal when the valves get pressed together later. Further, valves two(17) and three(18) have a holding recess 24 on the under side while valve one 16 has holding tabs 12 at its end. These will be explained later. The center of the cap is hollow with a set of valve support beams 20 dividing the hole into three feed holes 10. The valve support beams 20 form a set of three valve seating troughs 19 which will receive the corresponding pair of sealing ribs 13 later. In this way, the valve support beams 20 will act as positive stops preventing the valves 16, 17 and. 18 from caving in during transportation and handling of the device mounted on a bottle full of water. Finally, integrated with the cap body 5 is a cap removal pull tab 7 for the removal of the device from the bottle when it is emptied from consumption.

Figure 1B:
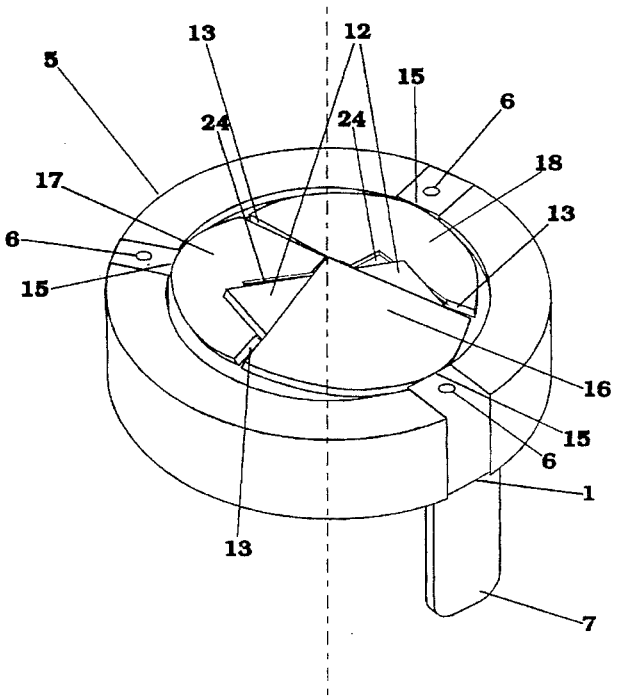

FIG. 1B shows the situation when the three valves 16, 17 and 18 are folded back into the center cavity of the cap till their sealing ribs 13 just touch one another. The folding is effected via the body living hinges 1 and the valve living hinges 15 with the valve beams 33, 34 and 35 permanently captured onto the cap body 5. Notice that the valves are still bulged out of the horizontal plane by design. Also notice that the holding tabs 12 of valve one 16 are just about fitting into the corresponding holding recesses 24 of valve two 17 and valve three 18. Since the material of the device is somewhat compliant, the three valves can be forced into the horizontal plane resulting in a controlled amount of interference fit against one another. In this way, a repeatable amount of minimum shock would be required to pop the valves 16, 17 and 18 open with respect to the valve living hinges 15, this will be shown later.

Figure 2A:
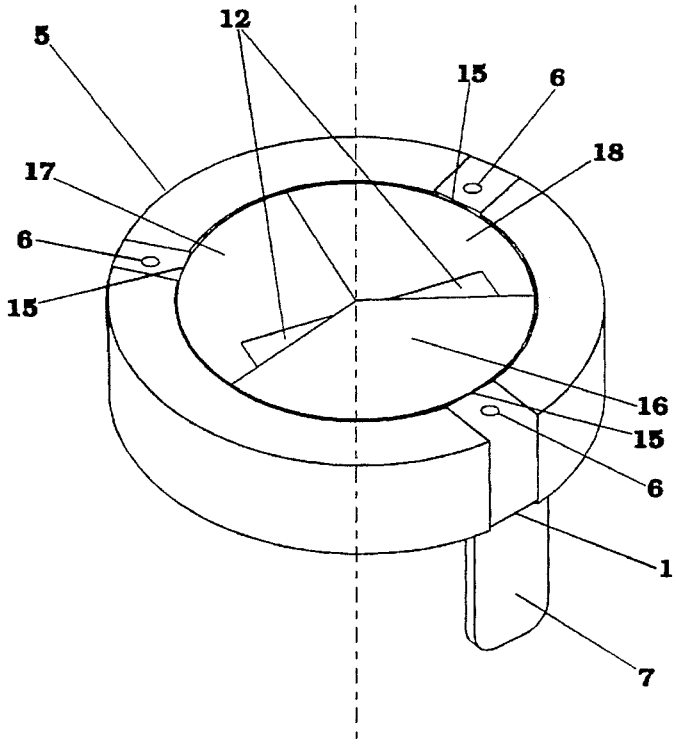
FIG. 2A shows the triple valve cap closure after the three valves are pressed completely into the center cavity to form an interference seal against water spillage.

FIG. 2A shows the situation when the three valves 16, 17 and 18 have been forced into the horizontal plane. Notice that valves two 17 and three 18 are prevented from opening by the holding tabs 12 of valve one 16. If desired, the valves 16, 17 and 18 can be made so that they move lightly beyond the horizontal plane to a stable, lower energy position. This will increase the stability of the valve in the closed position and increase the threshold of force needed to open the valve.

Figure 2B:
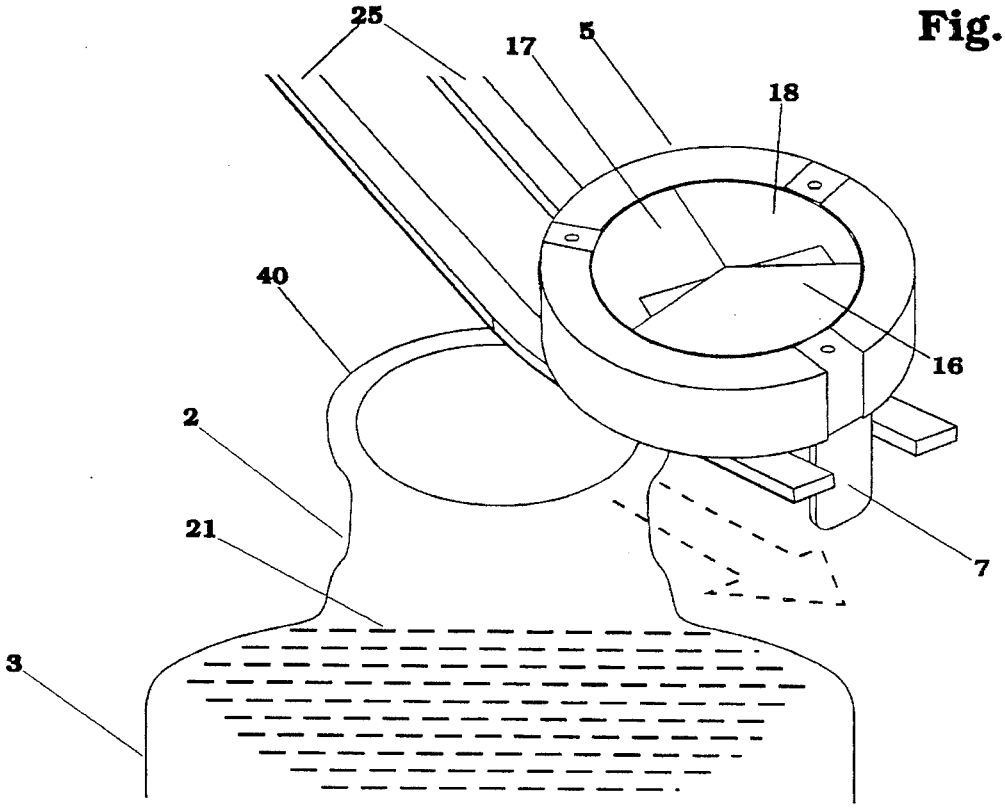
FIG. 2B illustrates the situation on a bottling line where the triple valve cap has been fed to the end of a feeding track waiting for an oncoming full bottle to capture it onto the bottle top
Figure 3A:
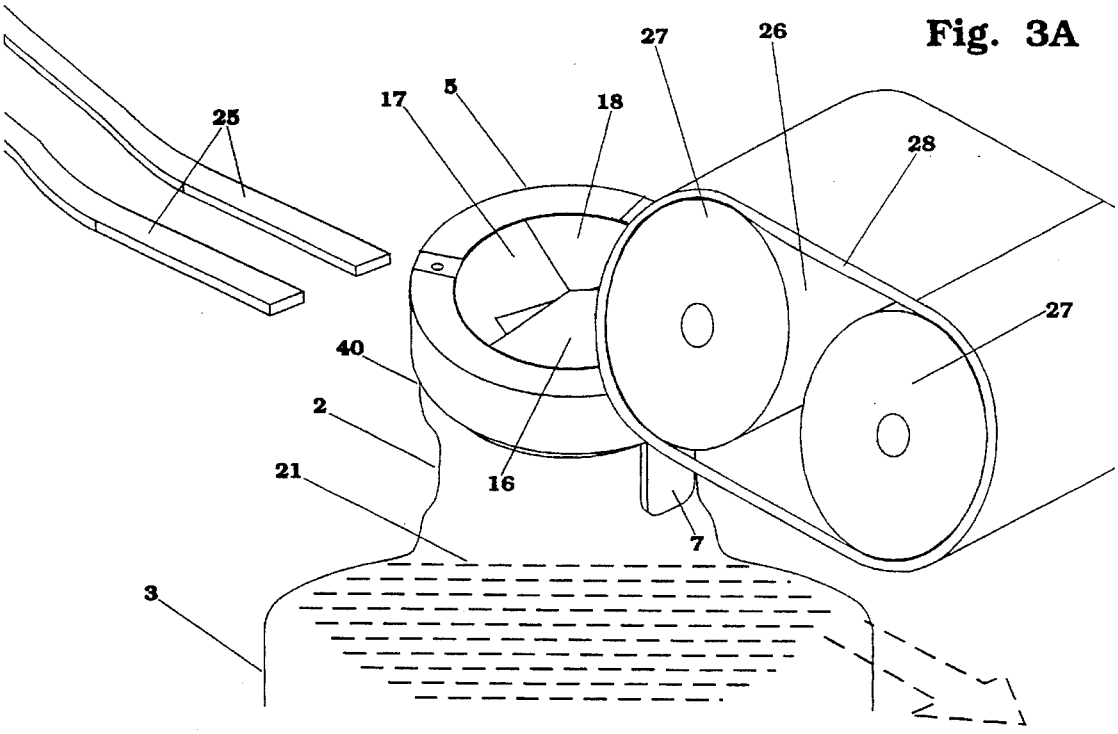
FIG. 3A shows the triple valve cap being pressed down onto the bottle by a capping mechanism after the cap gets captured by the moving bottle from the feeding track.

The situation on a bottling line just prior to a capping operation is illustrated in FIG. 2B. The device is pre-registered and transported to the end of cap feeding tracks 25 with the cap removal pull tab 7 at its down stream end. Meanwhile, a bottle 3 just filled with water 21 is being transported along the same direction of the cap feeding tracks 25 so that the rim 40 of the bottle neck 2 will capture the device by the cap removal pull tab 7 upon further motion along the same direction. This is indicated by the dotted arrow. At the next stage of the bottling line, shown in FIG. 3A, the cap body 5 is pressed onto the rim 40 of the bottle 3 by the bottle capping mechanism 26. The bottle capping mechanism 26 has a capping belt 28 which runs on capping rollers 27. The belt 28 presses the cap body 5 onto the bottle 3. At the same time, the belt 28 also presses the valves 16, 17 and 18 to be sure that the closure is thoroughly sealed. Because the cap removal pull tab 7 is positioned perpendicular to the first valve 16, it assures that the cap is oriented properly so that the holding tabs 12 press down and hold the other two valves 17 and 18.

Figure 3B:
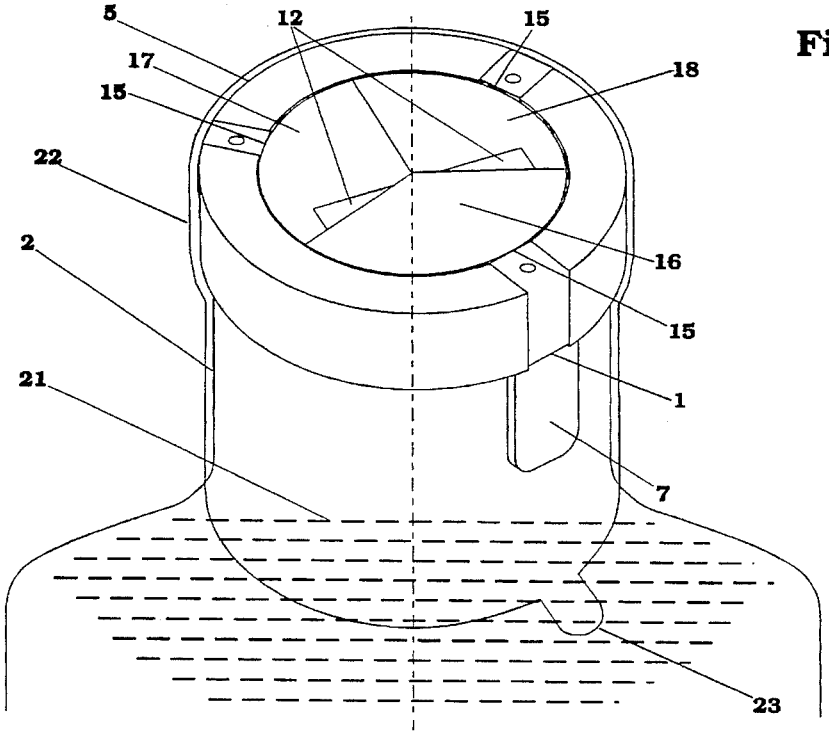
FIG. 3B shows the triple valve cap and bottle after the capping operation and the application of a shrink film overwrap.

After the cap has been applied, an overseal of heat shrink film 22 is applied to hold the cap closed and to ensure sanitation during shipment of the water bottle, as shown in FIG. 3B. The heat shrink film 22 includes a heat shrink pull tab 23 that allows the user to conveniently remove the heat shrink film 22 prior to use. Other types of protective film can also be used in place of heat shrink film to make the protective overseal 22, including UV shrinkable plastic film, stretch film, foil, paper or waxed paper.

Figure 10:
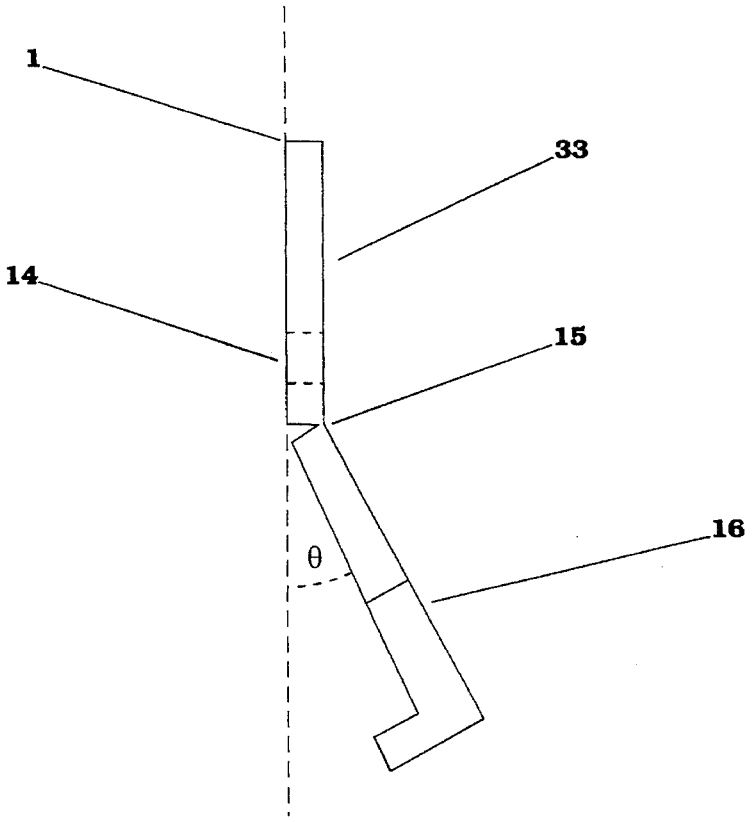
FIG. 10 shows a side view of a valve which is molded with a bias toward the open position.
Figure 11:
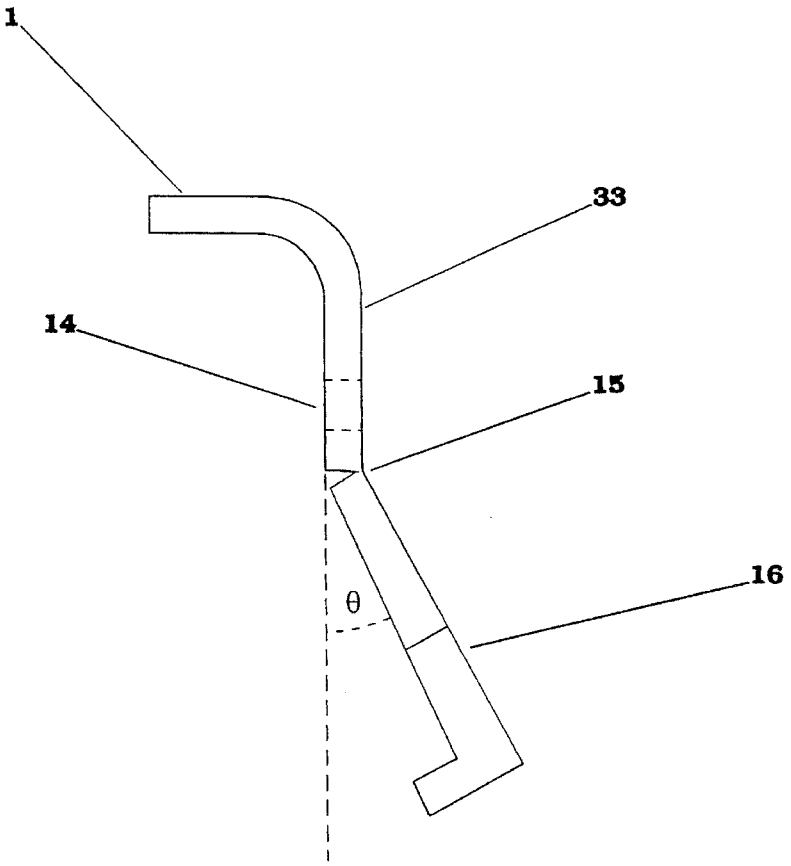
FIG. 11 shows a side view of a valve which is molded with a bias toward the open position and a curved valve beam.

Certain variations of the three-valve cap have been contemplated by the inventors. For home applications of the cap, where the user applies the cap to a water bottle prior to loading, the holding tabs 12, which are designed to facilitate automated bottle capping, may be unnecessary. The user can easily press the three valves 16, 17 and 18 down simultaneously to close the cap or the cap can be supplied to the user with the valves 16, 17 and 1.8 closed and held in place with plastic shrink wrap or other sanitary cover. Also, although the various embodiments are illustrated and described as having a press fit with the bottle neck, other means of attachment, such as screw threads on the cap and the bottle neck, might also be used. Another minor variation of the cap is illustrated in FIG. 10 which shows a side view of one of the three valves 16, 17 and 18. In this variation, the valve living hinge 15 is molded with a bias toward the open position as indicated by the angle θ between the valve 16 and the valve beam 33. Additionally, the valve beam 33 can be molded with a curve, as shown in FIG. 11, that facilitates bending the valve beam 33 around the curved edges of the cap body 5 while closing the valve 16. If this variation of the valve is used, the cap body 5 should also be molded with a corresponding curve to match the curve of the valve beam 33.

Several alternative constructions are possible for the valve living hinges 15 which join the valves 16, 17 and 18 to the cap body 5. One slight variation is to increase the flexibility of the valve living hinges 15 by molding each hinge with a slot through the material where it thins out to form the flexible hinge. This reduces the material in the hinge, making it more flexible without the difficulty of molding extremely thin sections. To prevent water from leaking through the slots in the living hinge, the cap body 5 can be molded with corresponding bumps that will help to seal the slots when the valves are closed. Another variation is to replace the valve beams and the living hinges with a more conventional pivoting hinge. The pivoting hinge can be made with detents in the pivot which give the valves a stable open position and a stable closed position. This alternate construction may be preferred for preventing problems of material fatigue or creep which could manifest themselves over the longterm with the living hinges.

Figure 7A:
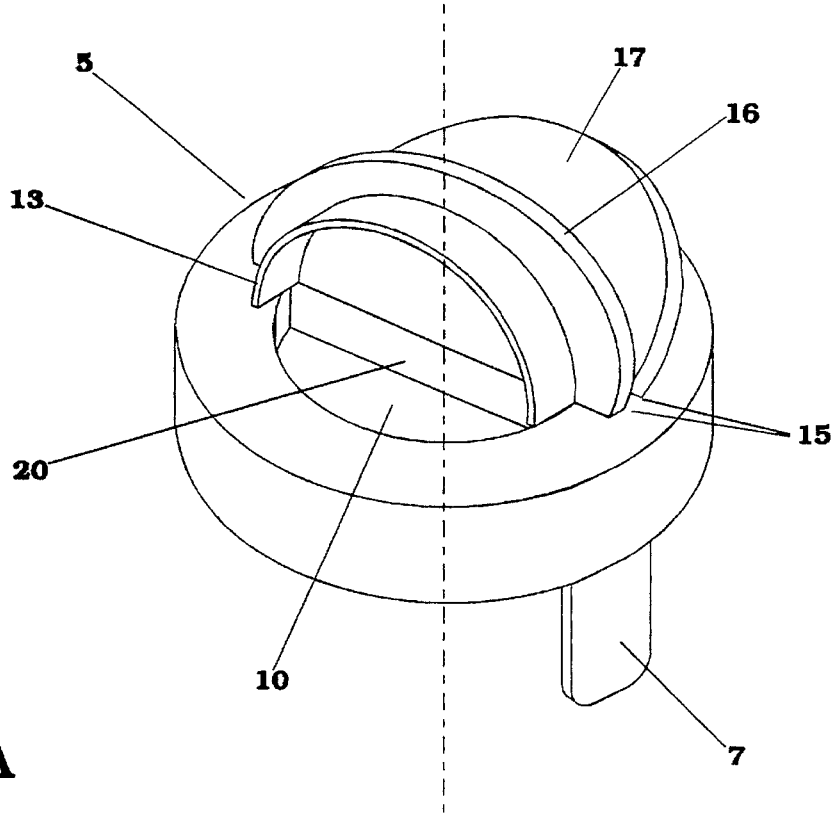
FIGS. 7A and 7B show a cap closure with dual valves as it is molded and after the valves are pressed completely into the center cavity during the manufacturing process.
Figure 7B:
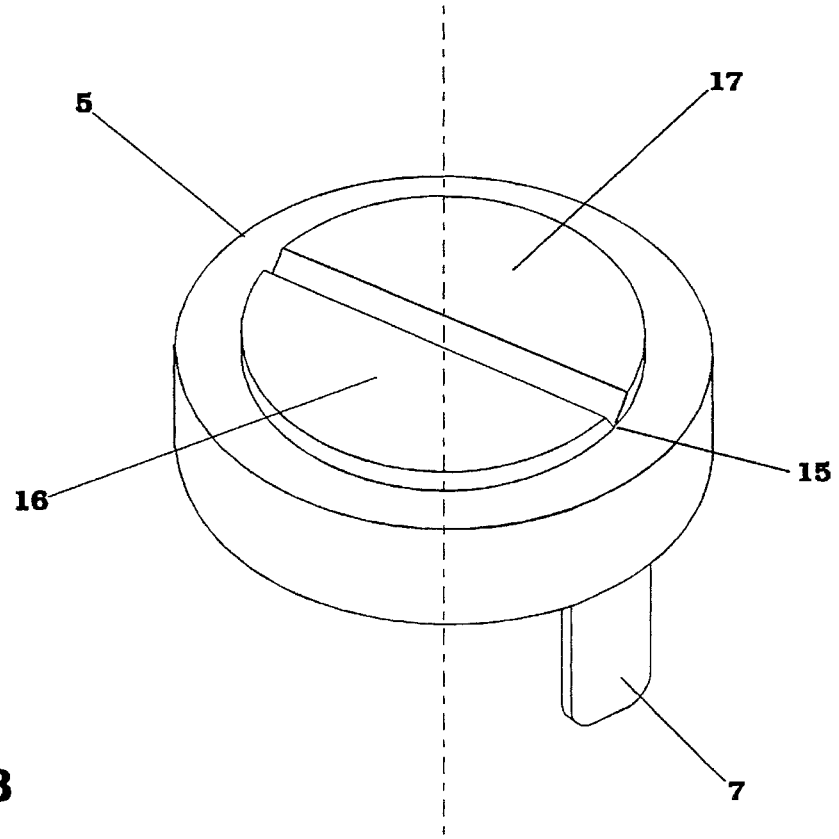

FIGS. 7A and 7B illustrate a two-valve embodiment of the present invention. Identical reference numbers have been used to refer to pans analogous to those shown in the previous Figures. FIG. 7A shows the two-valve cap in the open position. The cap body 5 is made so that it fits over and attaches to the mouth of a water bottle. A valve support beam 20 supports two valves 16, 17 which are pivotally attached to the beam 20 by living hinges 15. The beam 20 is preferably arranged perpendicular to the cap removal pull tab 7, as illustrated, so that the pull tab 7 provides registration for the cap in an automatic bottle capping system. When the cap is in the closed position, as in FIG. 7B, the sealing ribs 13 form an interference fit with the rim of the feed holes 10 to seal the cap and to hold it closed.

Figure 8A:
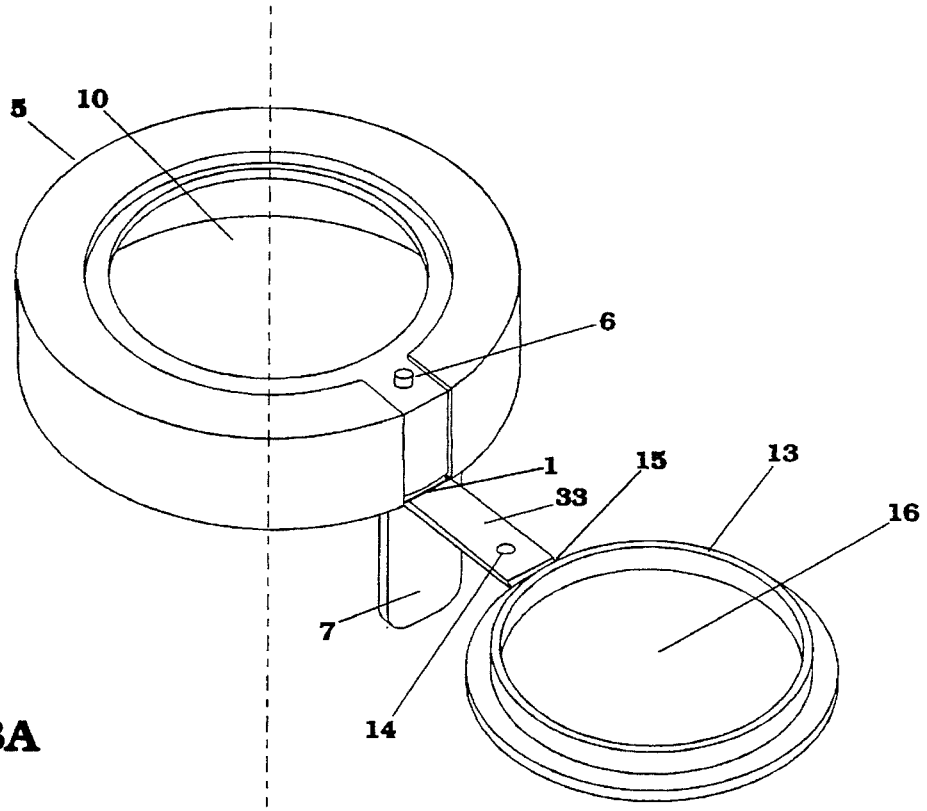
FIGS. 8A and 8B show a cap closure with a single valve as it is manufactured and after the valve is pressed completely into the center cavity to form an interference seal against water spillage.
Figure 8B:
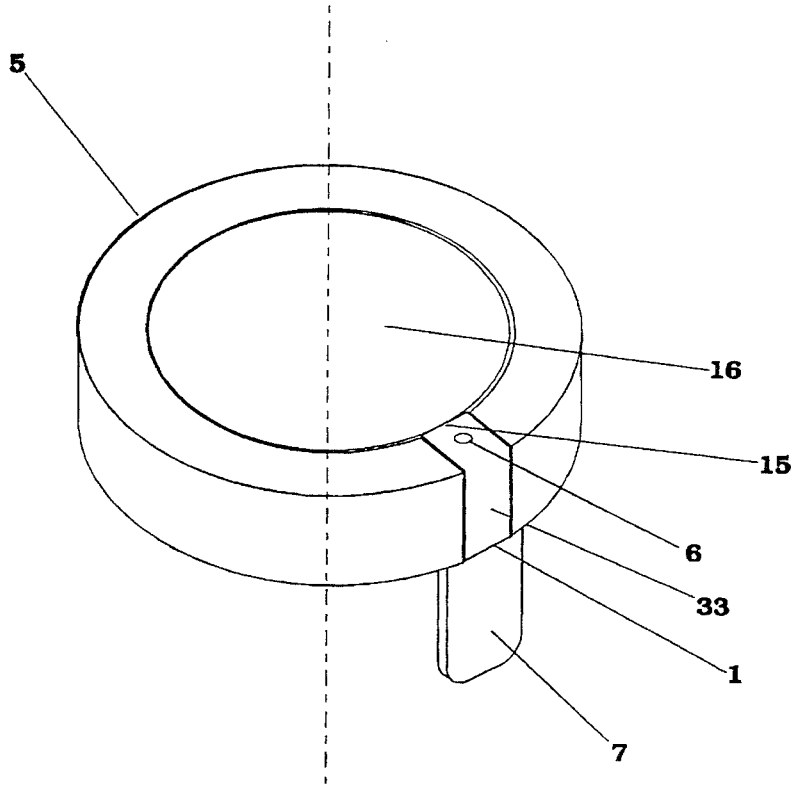

FIGS. 8A and 8B illustrate a single-valve embodiment of the present invention. Once again, identical reference numbers have been used to refer to pans analogous to those shown in the previous Figures. FIG. 8A shows the single-valve cap in the open position. The cap body 5 is made so that it fits over and attaches to the mouth of a water bottle. The single valve 16 is attached to the cap body 5 by a single valve beam 33. The valve beam 33 is pivotally attached to the valve 16 on one end by the valve living hinge 15 and is pivotally attached to the cap body 5 on the other end by the body living hinge 1. The beam 33 has a valve beam locking hole 14 which is sized to have a tight interference fit with the cap body locking post 6. The beam 33 and valve 16 are preferably arranged perpendicular to the cap removal pull tab 7, as illustrated, so that the pull tab 7 provides registration for the cap in an automatic bottle capping system. When the cap is in the closed position, as in FIG. 8B, the valve 16 is pivoted upward at the body living hinge 1, the valve beam locking hole 14 snaps over the cap body locking posts 6 and the sealing rib 13 forms an interference fit with the rim of the feed hole 10 to seal the cap and to hold it closed.

Figure 9A:
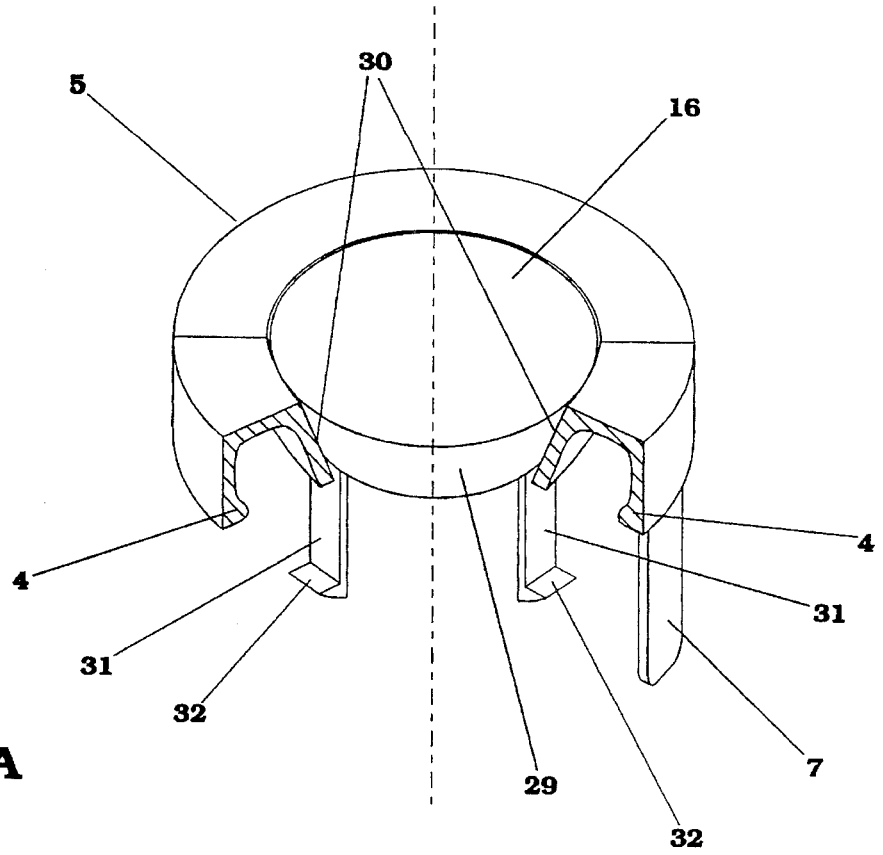
FIG. 9A shows a cap closure with a linear valve pressed completely into the center cavity to form an interference seal against water spillage.
Figure 9B:
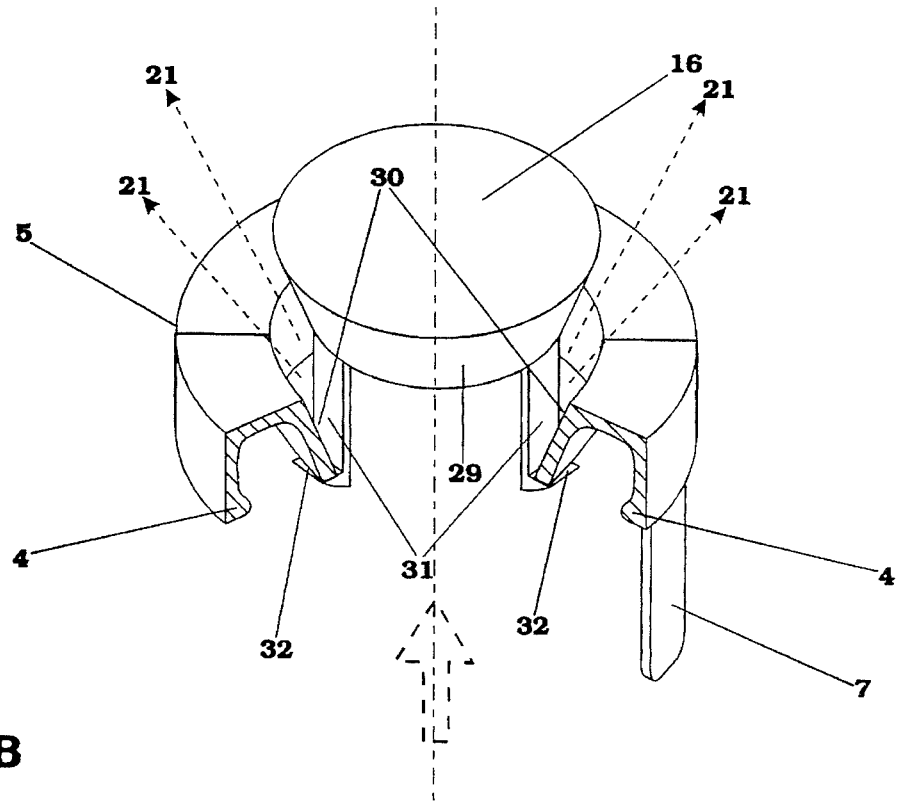
FIG. 9B shows the linear valve piece completely popped out of the center cavity allowing water to flow peripherally through the cap.

FIGS. 9A and 9B show an alternate embodiment of the single-valve cap closure which has a linear valve to seal the releasable cap closure. The cap body 5 is made so that it fits over and attaches to the mouth of a water bottle with the bottle gripping rim 4. The valve 16 is made with a valve body interference surface 29 that presses into and seals against the cap body interference surface 30 to form an interference seal against water spillage. The valve 16 is slidingly attached to the cap body 5 by valve body guide beams 31 which terminate in guide beam hooks 32 to prevent the valve 16 from coming loose from the cap body 5. When the valve 16 is open, as in FIG. 9B, the water flows peripherally around the valve 16, as indicated by the dotted arrows 21.

OPERATIONAL DESCRIPTION

To practice the nonspill water replacement system of the present invention, the water or other fluid is provided in a rigid bottle with a releasable cap closure as described in the various embodiments above. The releasable cap closure, which provides an initial watertight seal to the water bottle, may be installed at the bottling plant or it may be applied by the end user. When the user wishes to replace the water bottle on a water dispenser, the empty bottle is removed and a new bottle is prepared by removing any protective film that may have been placed over the releasable cap closure. The full bottle is lifted, inverted and placed over the water dispenser. In order to release the watertight seal of the releasable cap closure, the user generates a hydraulic shock wave in the water inside the bottle. The shock wave opens the seal and allows the water to flow from the bottle. Three methods for generating the necessary hydraulic shock wave are described below. For illustrative purposes only, the methods are described using the releasable cap closure 50 shown in FIGS. 1A, 1B, 2A and 2B, although any one of the described embodiments may be used for these methods.

Figure 4A:
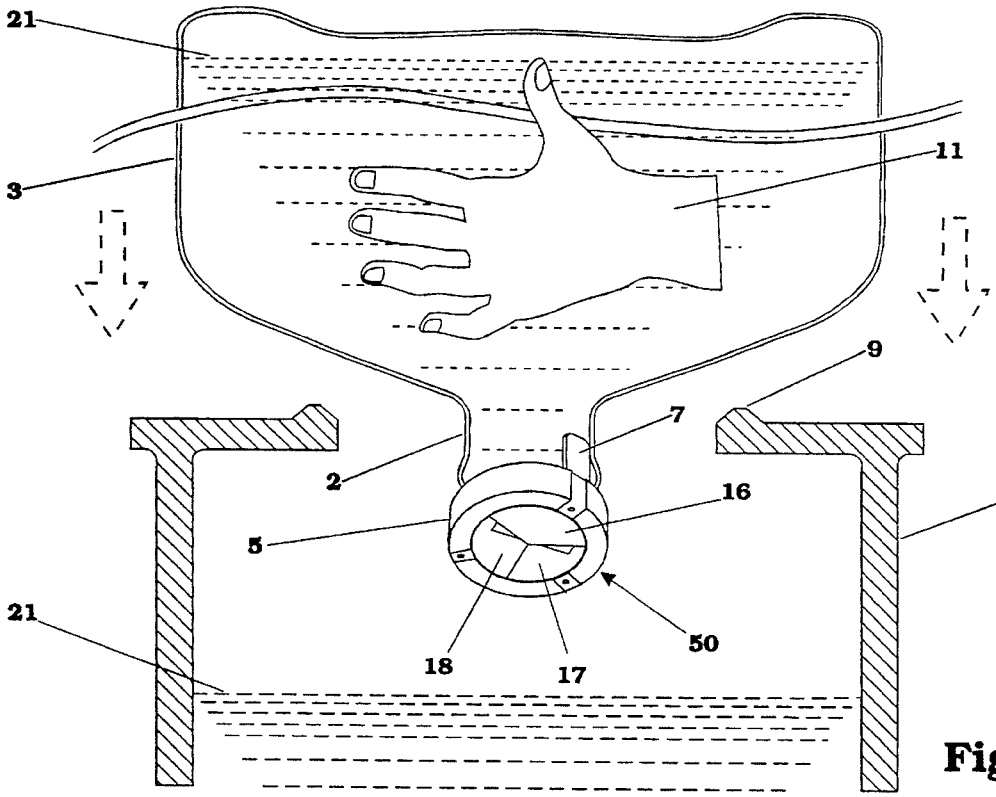
FIGS. 4A & 4B illustrate a first method of creating a hydraulic shock wave to open the triple valve seal.
Figure 4B:
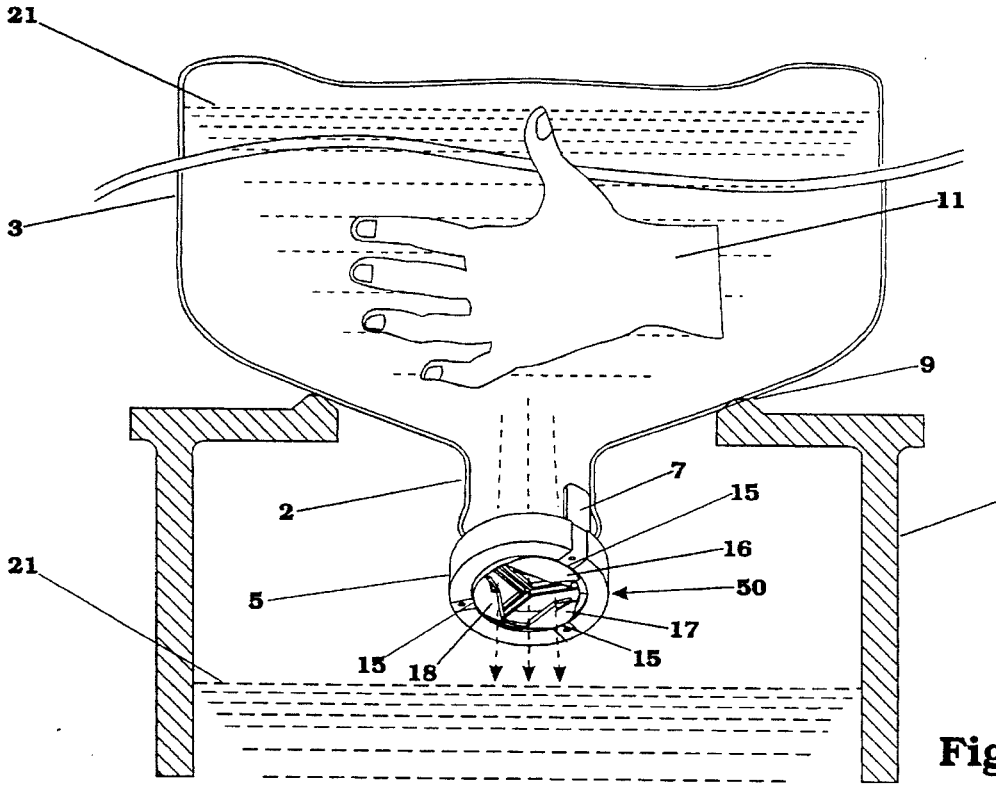

FIGS. 4A & 4B illustrate a first method of creating a hydraulic shock wave to open the releasable cap closure 50. In this method, the water bottle 3 is positioned a few inches, typically one to four inches above the top opening of the water dispenser 9, as shown in FIG. 4A. The bottle is then lowered rapidly onto the dispenser opening 9. When the bottle 3 comes to rest on the top of the dispenser 9, the inertia of the water 21 in the bottle creates an inertial shock wave. This inertial shock wave is concentrated by the tapered neck 2 of the bottle 3, in the manner of a hydraulic ram, so that it increases in magnitude as it travels down the neck of the bottle. When the shock wave strikes the releasable cap closure 50, the valves 16, 17, 18 open, allowing the water 21 to flow from the bottle into the dispenser 8, as shown in FIG. 4B.

Figure 5A:
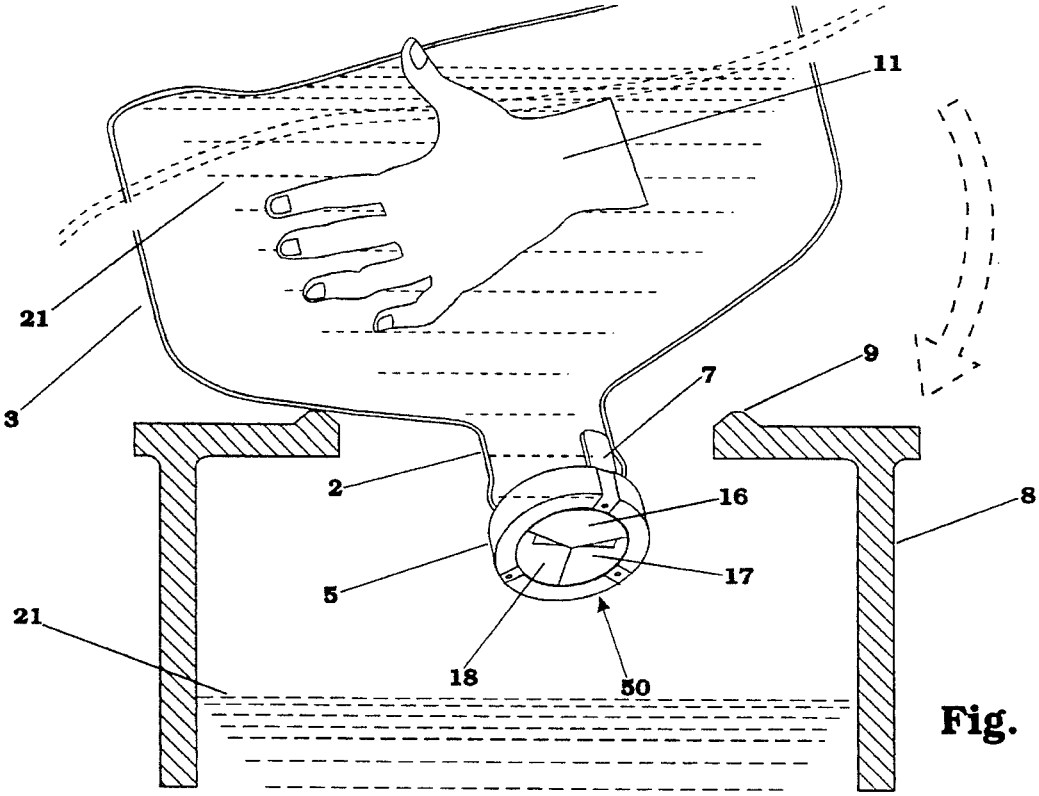
FIGS. 5A & 5B illustrate a second method of creating a hydraulic shock wave to open the triple valve seal.
Figure 5B:
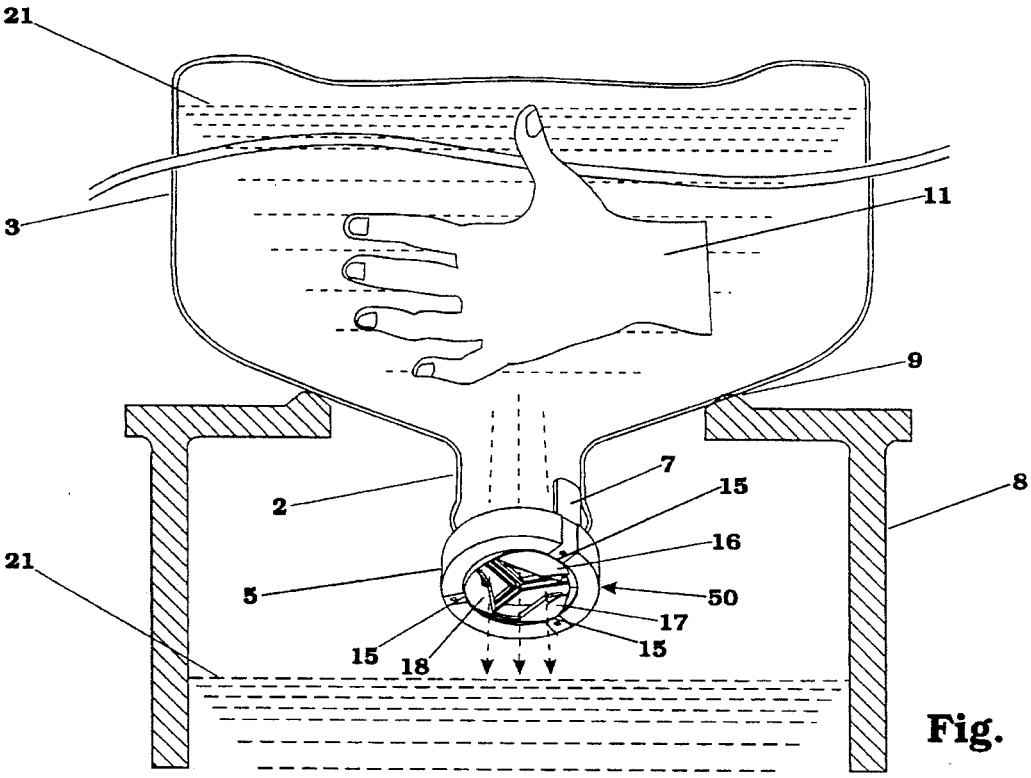

FIGS. 5A & 5B illustrate a second method of creating a hydraulic shock wave to open the releasable cap closure 50. In this method, the water bottle 3 is placed on the top opening of the water dispenser 9 with the releasable cap closure 50 in the closed position. The bottle 3 is then tipped so that one shoulder of the bottle is a few inches, typically one to four inches above the top opening of the water dispenser 9, as shown in FIG. 5A. Then, the bottle 3 is allowed to settle back into place on top of the dispenser 9, which creates an inertial shock wave when the bottle 3 comes to rest. The shock wave is concentrated as it travels down the tapered neck 2 of the bottle 3, where it strikes the releasable cap closure 50 and opens the valves 16, 17, 18 to allow the water 21 to flow from the bottle into the dispenser 8, as shown in FIG. 5B.

Figure 6A:
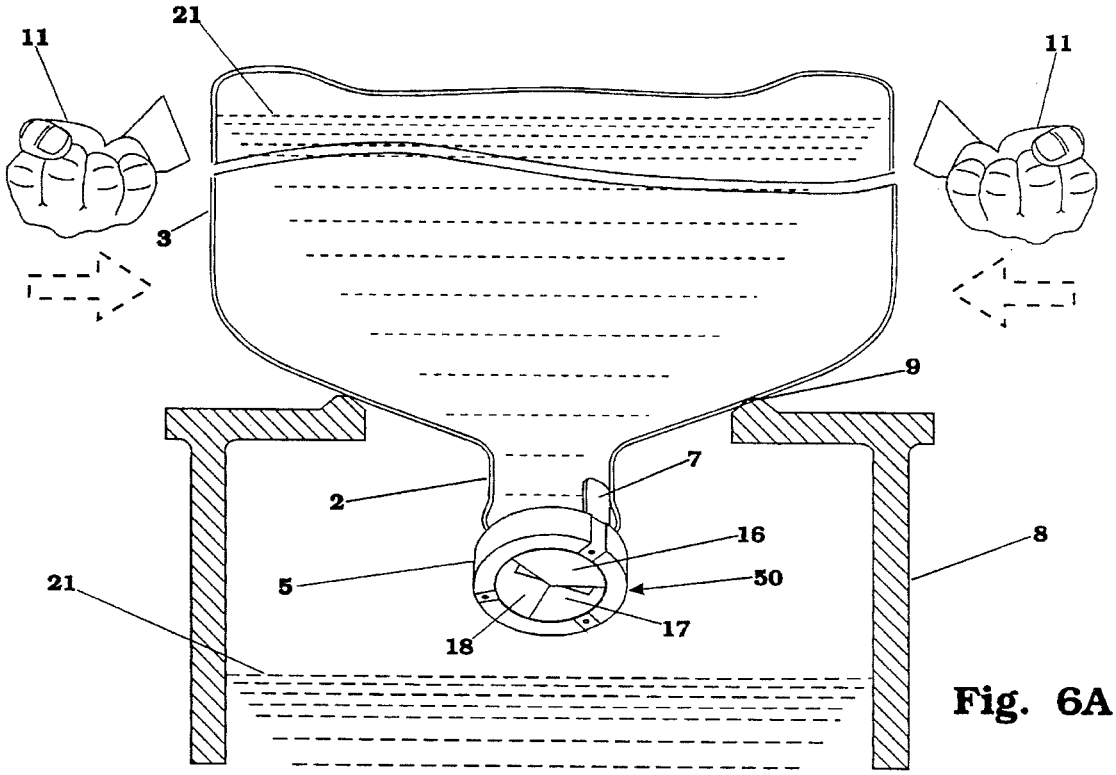
FIGS. 6A & 6B illustrate a third method of creating a hydraulic shock wave to open the triple valve seal.
Figure 6B:
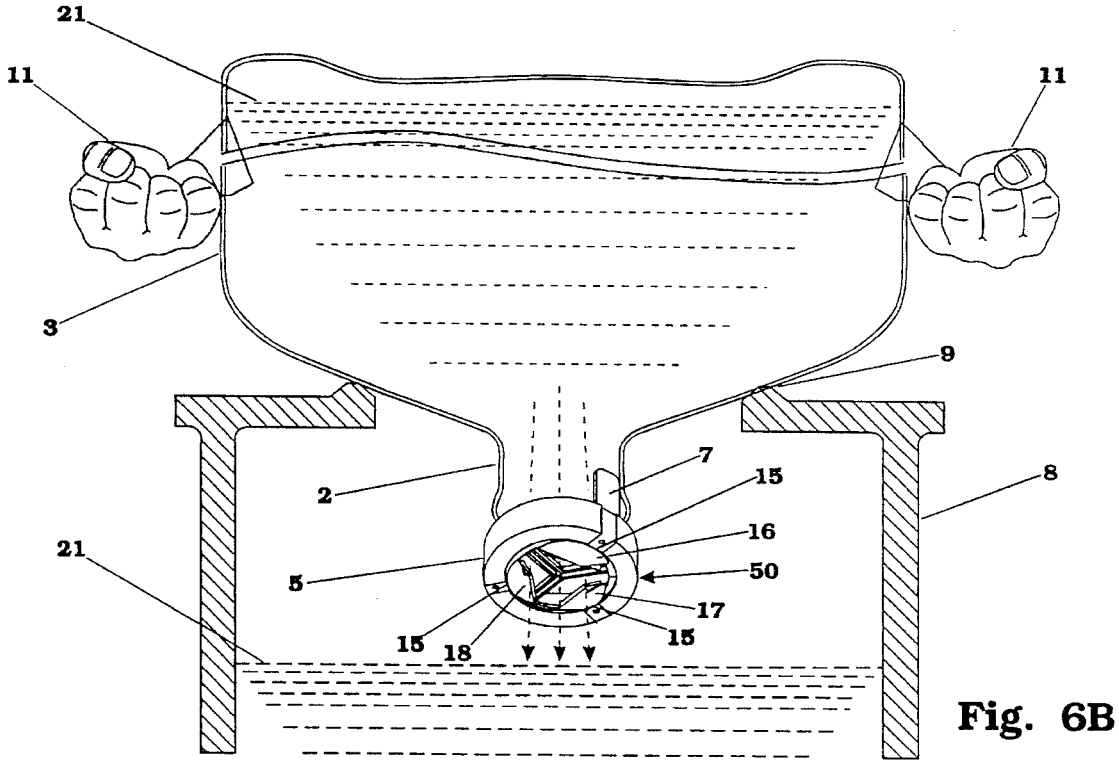

FIGS. 6A & 6B illustrate a third method of creating a hydraulic shock wave to open the releasable cap closure 50. In this method, the water bottle 3 is placed on the top opening of the water dispenser 9 with the seal intact, as shown in FIG. 6A. The user strikes the bottom or the sides of the water bottle 3 to create a hydraulic shock wave. The user must strike the bottle sharply, simply squeezing the bottle will not create the required shock wave which is needed to open the releasable cap closure 50. The shock wave is concentrated as it travels down the tapered neck 2 of the bottle 3, where it strikes the releasable cap closure 50 and opens the valves 16, 17, 18 to allow the water 21 to flow from the bottle 3 into the dispenser 8, as shown in FIG. 6B.

With any one of the disclosed methods, the user can carefully place the water bottle on or over the water dispenser without danger of spillage. Then, once the bottle is safely in place, the user can initiate a hydraulic shock wave which opens the seal and allows the water to flow out.

Although the examples given include many specificities, they are intended as illustrative of only some of the possible embodiments of the invention and methods for their use. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

We claim:

1. A bottle cap, comprising:

a cap body, said cap body having at least one aperture therethrough, a cap attachment means for attaching said cap body to a bottle, at least one valve member, and a movable attachment means for movably attaching said at least one valve member to said cap body, said at least one valve member having an interference fit with said at least one aperture such that said at least one valve member seals said at least one aperture, wherein said at least one valve member resists dislodgement from said at least one aperture when subjected to a force which is less than a given threshold force, and wherein said at least one valve member is made to dislodge from said at least one aperture when subjected to a force which is greater than said given threshold force, wherein said at least one aperture comprises three sector-shaped apertures, said three sector-shaped apertures being separated by a Y-shaped beam, and said at least one valve member comprises three sector-shaped valve members, each of said three valve members being pivotally attached to said cap body by at least one flexible living hinge, each of said three sector-shaped valve members serving to seal one of said three sector-shaped apertures, respectively.

2. The bottle cap of claim 1, wherein each of said three valve members is attached to said cap body by a valve attachment beam having a first end and a second end, said first end of said valve attachment beam being attached to said cap body by a first flexible living hinge, said second end of said valve attachment beam being attached to said at least one valve member by a second flexible living hinge.

3. The bottle cap of claim 2, wherein said valve attachment beam further comprises a hole intermediate said first end and said second end, and said cap body further comprises a locking post having a fight interference fit with said hole.

4. A bottle cap, comprising:

a cap body, said cap body having an opening therethrough, said opening being divided into three sector-shaped apertures by a Y-shaped beam, a cap attachment means for attaching said cap body to a bottle, three sector-shaped valve members, each of said three valve members being pivotally attached to said cap body by at least one hinge, each of said three sector-shaped valve members serving to seal one of said three sector-shaped apertures, respectively, said three sector-shaped valve members having an interference fit with one another and with said opening such that said three sector-shaped valve members seal said opening, wherein said three sector-shaped valve members resist dislodgement from said opening when subjected to a force which is less than a given threshold force, and wherein said three sector-shaped valve members are made to dislodge from said opening when subjected to a force which is greater than said given threshold force.

5. The bottle cap of claim 4, wherein each of said three valve members is attached to said cap body by a valve attachment beam having a first end and a second end, said first end of said valve attachment beam being attached to said cap body by a first flexible living hinge, said second end of said valve attachment beam being attached to said at least one valve member by a second flexible living hinge.

6. The bottle cap of claim 5, wherein said valve attachment beam further comprises a hole intermediate said first end and said second end, and said cap body further comprises a locking post having a fight interference fit with said hole.

7. A method of installing a bottle of fluid onto a fluid dispenser without spilling the fluid, comprising the steps of:

(a) providing the fluid in a bottle made of a rigid material, (b) sealing said bottle with a bottle cap, said bottle cap comprising:

a cap body, said cap body having at least one aperture therethrough, a cap attachment means for attaching said cap body to a bottle, at least one valve member, and a movable attachment means for movably attaching said at least one valve member to said cap body, said at least one valve member having an interference fit with said at least one aperture such that said at least one valve member seals said at least one aperture, wherein said at least one valve member resists dislodgement from said at least one aperture when subjected to a force which is less than a given threshold force, and wherein said at least one valve member is made to dislodge from said at least one aperture when subjected to a force which is greater than said given threshold force, (c) inverting said bottle and positioning said bottle over said dispenser, (d) inducing a hydraulic shock wave in the fluid within said bottle, said hydraulic shock wave causing a force on said at least one valve member which is greater than said given threshold force which is effective to dislodge said at least one valve member from said at least one aperture, thereby allowing said fluid to flow from said bottle into said dispenser.

8. The method of claim 7 wherein said hydraulic shock wave is induced by lowering said bottle onto said dispenser at a sufficient velocity such that the inertia of said fluid is sufficient to cause an inertial shock wave in said fluid of sufficient magnitude to dislodge said at least one valve member from said at least one aperture when said bottle comes to rest on said dispenser.

9. The method of claim 7 wherein said hydraulic shock wave is induced by lowering said bottle onto said dispenser, tilting said bottle from its equilibrium position, then allowing said bottle to settle onto said dispenser at a sufficient velocity such that the inertia of said fluid is sufficient to cause an inertial shock wave in said fluid of sufficient magnitude to dislodge said at least one valve member from said at least one aperture when said bottle comes to rest on said dispenser.

10. The method of claim 7 wherein said hydraulic shock wave is induced by lowering said bottle onto said dispenser, then striking said bottle to cause a shock wave in said fluid of sufficient magnitude to dislodge said at least one valve member from said at least one aperture.

11. The method of claim 7 wherein said bottle is made of a rigid polymer.

12. The method of claim 11 wherein said rigid polymer is polycarbonate.

* * * * *